United States Patent [19]

Boden

[11] Patent Number: 4,858,549

[45] Date of Patent: Aug. 22, 1989

[54] FAST BOAT

[75] Inventor: Wilhelm Boden, Kappeln, Fed. Rep. of Germany

[73] Assignee: Dealermain Ltd., London, England

[21] Appl. No.: 916,195

[22] Filed: Oct. 7, 1986

[30] Foreign Application Priority Data

Oct. 11, 1985 [DE] Fed. Rep. of Germany ..... 3536408

[51] Int. Cl.[4] ..... B63B 1/18

[52] U.S. Cl. ..... 114/56; 114/61

[58] Field of Search ..... 114/62, 61, 56, 271, 114/291, 285, 286, 287, 288; 440/46; 441/74

[56] References Cited

U.S. PATENT DOCUMENTS

| | | | |
|---|---|---|---|
| 3,137,261 | 6/1964 | Noe | 114/62 |
| 3,404,651 | 10/1968 | Jensen et al. | 114/287 |
| 4,055,140 | 10/1977 | Kirchhan | 440/46 |
| 4,603,650 | 8/1986 | Björn | 114/288 |

FOREIGN PATENT DOCUMENTS

| | | | |
|---|---|---|---|
| 2524913 | 12/1976 | Fed. Rep. of Germany | 440/46 |
| 3136715 | 3/1983 | Fed. Rep. of Germany | 114/288 |
| 1536220 | 3/1967 | France | 114/288 |
| 8302926 | 9/1983 | World Int. Prop. O. | 441/74 |

*Primary Examiner*—Joseph F. Peters, Jr.
*Assistant Examiner*—Edwin L. Swinehart
*Attorney, Agent, or Firm*—Goodman & Teitelbaum

[57] ABSTRACT

Fast boat which comprises a boat hull having a front stem, a stern, two side walls as well as a bottom plate with a bottom plate surface facing the water, where on the bottom plate surface facing the water on each side respectively one sliding skid is arranged with sliding steps and preferably in the midships plane a keel skid is provided with keel steps, and between the sliding skids at least one aeration channel is formed, the boat hull being preferably equipped with a bow fin, in which the free bottom surface facing the water has primarily in the area between the longitudinal center of the boat and the stern an inclination which preferably declines towards the stern.

14 Claims, 4 Drawing Sheets

FAST BOAT

Figure 1:
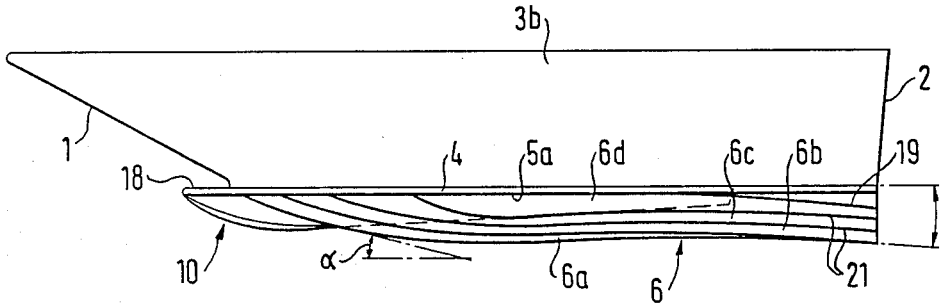

The invention concerns a fast boat.

The object of the invention is to influence the dynamic trim, in particular of the fast boat which is known from DE-OS No. 31 36 715.

This fast motorboat of DE-OS No. 31 36 715 consists essentially of a boat hull of the conventional construction with a boat's side, a forward stem, a stern and a bottom, in which the surface of the bottom pointing towards the water, the so-called bottom surface, is planar. From this bottom surface on the waterside, a sliding skid extends downwards laterally spaced from and symmetrically with the vertical midships plane, beginning respectively in the area of the leading edge of the bottom and extending to the stern, with a plurality of sliding graduations which decline in step form towards the exterior, with vertical stepside walls and with stepsliding surfaces which are arranged perpendicularly to said stepside walls. Each sliding step rises with a leading edge which is disposed transversely to the midships plane and forms with a flat curve a run-up sliding surface which is oriented downwards and to the rear and which changes over into a supporting surface which rises slightly upwards. The leading edge of the sliding steps are offset towards the rear and arranged with respect to each other so that the sliding step which is adjacent to the midships plane rises furthest forwards.

In the area of the midships plane, under the bottom surface facing the water, there is a keel skid which projects vertically downwards and which equally has on both sides laterally stepped declining keel steps with leading edges which are arranged transversely to the midships plane, with vertical side walls and with sliding surfaces which are arranged perpendicularly to said side walls. The keel step in the middle begins in the area of the forward stem; the keel steps which are lateral begin offset to the rear. The keel steps rise forward equally with a first curve and change over into a step surface which has a flat rise upwards and is either acutely angled or inclined moving into the bottom surface facing the water, wherein the keel skid ends slightly before the stern and the keel steps extend downwards by differing amounts so that the middle keel step extends furthest to the rear. The keel steps are designed to be narrower than the sliding steps of the slide skid.

At the point of transition between the walls on the side of the boat and the bottom surface facing the water or optionally shortly above or under this point, there is a bow fin which projects lateral from the side walls and forward from the stem in the form of a board-type strip, the form of which—when seen in plan view—is somewhat like the stern of a ship. This bow fin begins either arcuately or ogivally either before the front stem or it rises in the area of the front stem, projects laterally on both sides and changes acute-angled or with a flat curve into the side walls of the boat. The lower surface of the bow fin is preferably located in the plane of the bottom surface facing the water. By means of the bow fin it is in particular intended to ensure that the pitching movement of the ship is reduced when running into oncoming waves.

The arrangement of the sliding skids and of the keel skid in combination with the position of the bottom surface facing the water provides two adjacently disposed aeration channels which are separated from each other by the keel skid and which narrow like a wedge towards the rear, which corresponds to the aeration channels which are described in DE-PS No. 20 59 087 both in their shape and in their effects.

Moreover, from GB-PS No. 1 199 658 a boat hull is known with lateral sliding skids which possesses offset sliding steps which are stepped towards the exterior, in which the bottom surface facing the water, when observed from the side, begins in wedge shape at the front stem extending towards the rear, and changes over into a planar bottom surface extending to the stern which is parallel to the water line. The sliding steps rise as in the subject of DE-OS No. 31 36 715 with a straight edge which extends at right angles to the midships plane, at first arcuately, but then change over into a wedge surface which increases downwards. The sliding steps also begin offset to each other towards the rear, but they end with a vertical trailing edge step equally offset to each other, wherein the respectively further inward edge, i.e. adjacent to the midships plane, end further forward. Thereby the sliding step which is furthest inwards is the shortest, whereas the sliding step which is in the furthest outwards is the longest and extends as far as the stern.

This design of the sliding skid is not suitable to produce a substantial influence on the dynamic trim, because the effective sliding step surface of each sliding skid is reduced towards the stern.

The fast boat which is known from DE-OS No. 31 36 715 has proven itself. However, at very high speed an inclined position of the boat hull is produced such that the stern is lower than the bow, which in certain circumstances is caused by the bow fin. However, efforts are being made to maintain the boat hull as horizontal as possible even at maximal speeds, because in this way lower drive forces are necessary. This so-called hydrodynamic trim can only be achieved in the case of the known boats on account of the shape of the hold of the boat up to the water line, to a determined speed which is usually far removed from the maximal speed.

It is the object of the invention to ensure the hydrodynamic trim up to maximal speed in the case of a fast boat of the type described initially.

Figure 2A:
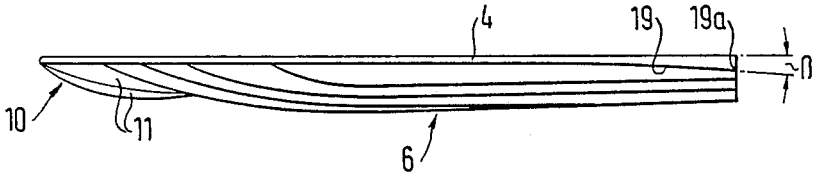
Figure 3:
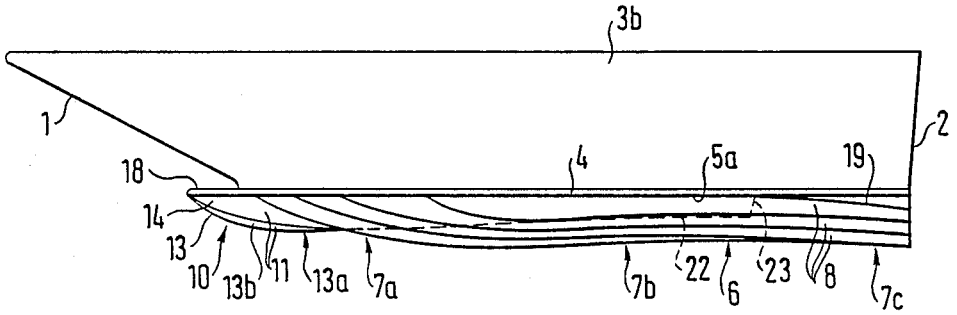
Figure 4:
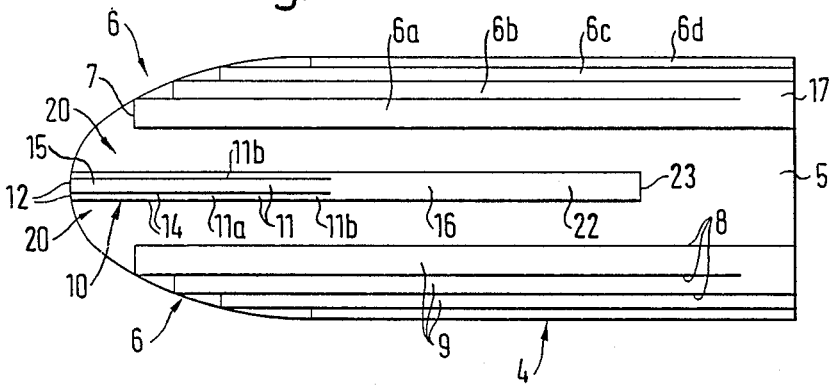
Figure 5:
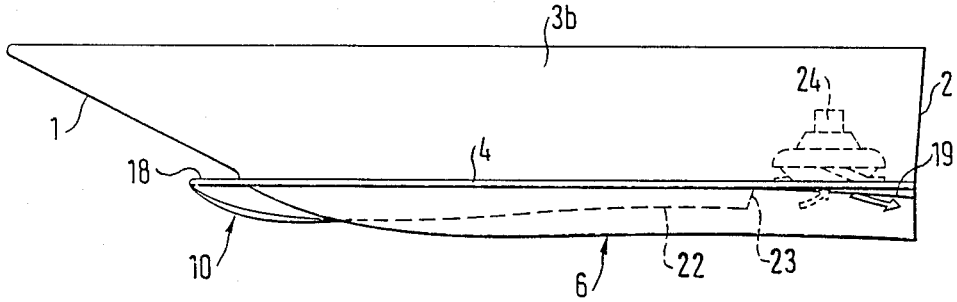
Figure 7:
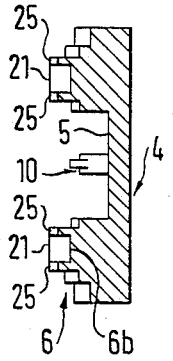
Figure 6:
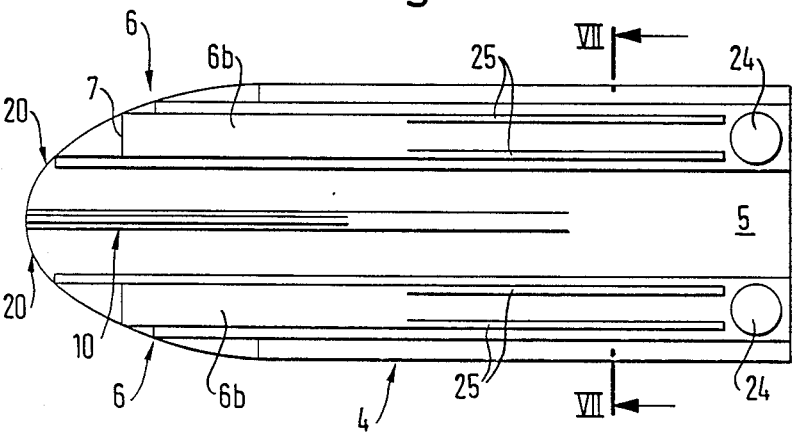
Figure 8:
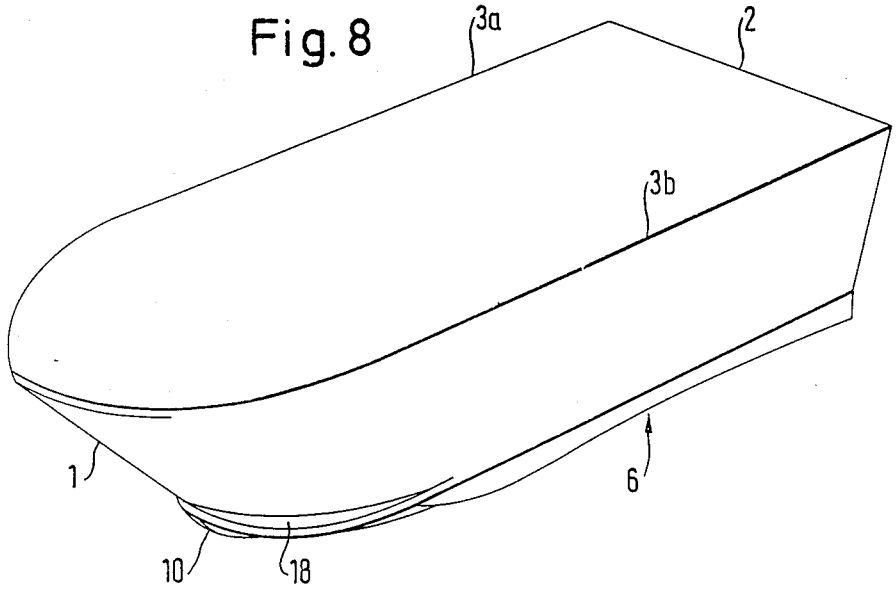
Figure 9C:
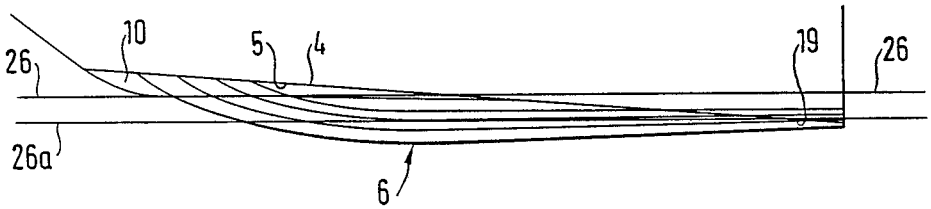
Figure 9B:
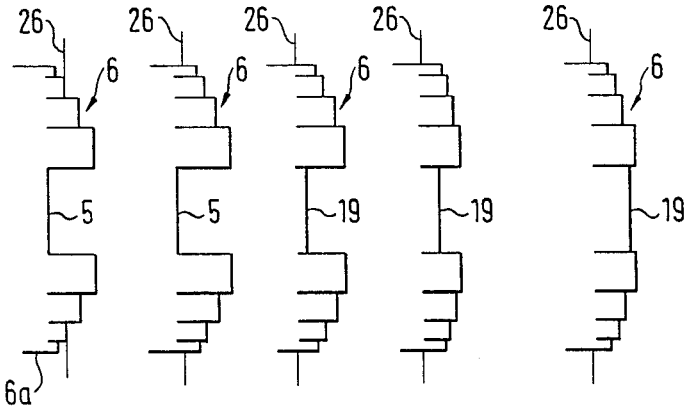
Figure 9A:
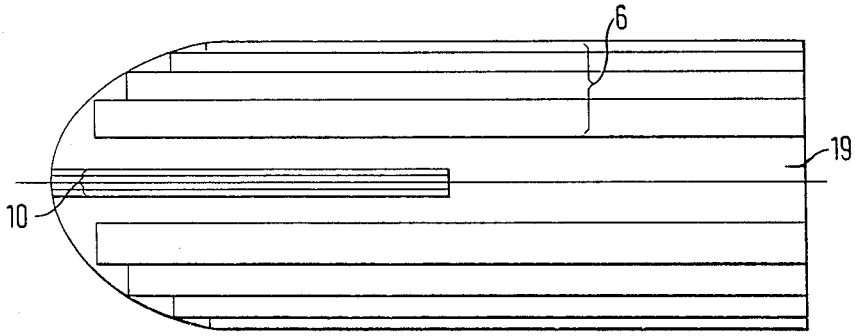

This object is achieved, proceeding from a fast motorboat by means of the characterizing features of this invention. Advantageous developments of the invention are characterized below. The invention will be described in more detail on the basis of the drawing, as an example. In the drawing, the figures show:

FIG. 1 a side view of the boat hull,

FIGS. 2*a, b, c* side views of the bottom plate with variants of the keel surfaces in the bottom surface facing the water and in the sliding skids, FIG. 3 a side view of the boat hull with further variants of keel surfaces in the keel skid, FIG. 4 a bottom view of the bottom plate, FIG. 5 a side view of the boat hull with a pump-jet drive, FIG. 6 a bottom view of a preferred bottom plate for a pump-jet-drive, FIG. 7 a cross-section along the line VII—VII in FIG. 6, FIG. 8 a perspective view of the boat hull, FIG. 9*a* a schematic bottom view of the boat hull up to the beginning of the keel skid, FIG. 9*b* schematic several cross sections through the boat hull without superstructural parts, FIG. 9*c* schematic side view of the boat hull, without superstructural parts.

The fast boat which is illustrated has a boat hull with front stem 1, stern 2, the two boat side walls 3, as well as the bottom plate 4 with the bottom surface facing the water 5. On each side respectively adjacent to and spaced from the midships plane (not shown), there is a sliding skid 6. The two sliding skids 6 are arranged to be mirror-symmetrical to each other towards the midships plane and have respectively a plurality of for example 4 sliding steps 6*a, b, c, d* (see FIGS. 1, 3 and 4). The sliding steps 6*a, b, c, d* rise in the bow area from the bottom surface facing the water 5 in an edge 7 which is arranged transversely to the midships plane and having a curve 7*a* which projects downwards and is inclined, preferably in a flat curve, and changes over to a horizontal portion 7*b*. The sliding steps have at least one vertical lateral surface 8 and perpendicularly to it, a sliding surface 9. The sliding steps, when observed in cross-section, are offset from each other outwardly under each other in steps, the step located further inwards projecting respectively more deeply. The original edges 7 are echeloned to the rear, in that the respective sliding step further inwards rises further forwards. The sliding steps preferably extend as far as the stern 2.

In the area of the midships plane, under the bottom surface facing the water 5, a keel skid 10 with keel step 11 is provided.

The leading edges 12 of all the keel steps 11 rise preferably adjacent to each other, wherein the middle keel step 11*a* begins with a deeper-reaching convex curve 13*a* and the keel step 11*b* next to it begins with a flatter curve 13*b*. The keel steps, like the sliding steps, have at least one vertical lateral surface 14 and respectively a sliding surface 15 which is arranged transversely to lateral surface 14. The keel step 11*a* moves backwards in wedge shape into the two keel steps 13*b*, so that connected thereto there is a broader keel step surface 16, wherein this broader keel step again opens in wedge shape into the bottom surface facing the water 5. In the same manner, for example the sliding step 6*a* can also flow in to the rear to sliding step 6*b*, the result of which is the broader surface 17. Preferably the outermost sliding step 6*d* is arranged to be approximately vertically flushed with the boat side walls 3*a* or 3*b*.

An aeration channel 20 is formed respectively between a sliding skid 6 and the keel skid 10, which aeration channel 20 is of the type described above for example in DE-PS No. 20 59 087.

On the boat hull, in the area of the front stem 1 and of the side walls 3*a, b* there is a bow fin 18 which projects from said side walls of the type described above for example in DE-OS No. 31 36 715. The bow fin 18 can rise at the front stem 1 and can extend ogivally or arcuately laterally towards the rear and flow in to the boat wall 3*a, b* in wedge shape (see FIG. 8). However, it can begin projecting from the front stem as well (FIGS. 1, 3 and 5). Furthermore it can be designed as an extension or as an expansion of the bottom plate 4 in the forward area, wherein the keel skid and the sliding skids can extend to the bottom surface of bow fin 18.

It is essential that the free bottom surface facing the water has an inclination in the area between the middle of the boat and the stern which declines towards the stern, which preferably rises without an edge in the bottom surface facing the water and is equally designed to decline either in planar or concave form. In the case of a flow running against the inclination 19, a lifting force is generated which increases with the speed of the flow and levers the stern out of the water. The length and surface size of the inclination 19 and its cutting angle $\beta$ (FIG. 2*a*) are coordinated with the cutting angle $\alpha$ as well as the length and surface size of the lifting inclinations 7*a*, 13*a*, 13*b* being coordinated with sliding steps 6*a, b, c, d* and with keel steps 11*a*, 11*b* as well as with the wedge shaped design of the aeration channels 20, but especially with the size of the surface of bow fin 18 in such manner that at almost all speeds an independent calibration of the boat results, i.e. the boat always adopts a horizontal position in the water or a predetermined position in the water which deviates slightly therefrom. The lifting force, which is produced by the flow of water pressing against the lifting inclinations of the skids and of the aeration channels, operates essentially on the bow of the boat, whereas the lifting force generated by the flow of water pressing against the inclination 19 takes effect on the stern area of the boat and compensates for the former elevating force. The dynamic center of buoyancy of the lifting force therefore remains automatically in the place at which the point of attack is located for a horizontal position in the water of the boat. The boat is, with a horizontal position in the water, raised further out of the water with increasing speed or with increasing flow force. What is surprising is the fact that the boat does not at high speeds "stick fast" with its stern.

Figure 2B:
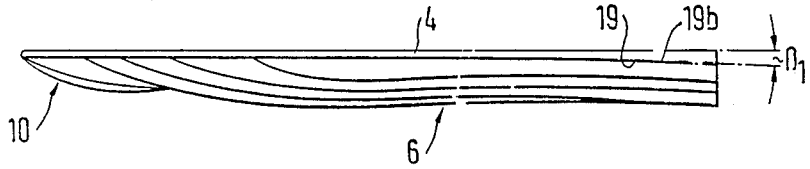
Figure 2C:
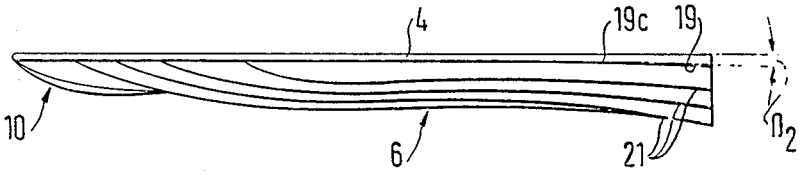

To support the effect of inclination 19, an inclination 21 can equally be provided in the stern area of the sliding steps (FIGS. 1, 2*c*). FIGS. 2*a*, and 2*b*, on the other hand, show rising (FIG. 2*a*) or horizontal (FIG. 2*b*) skid curves in the stern area. The inclinations 21 are particularly effective when two or more of the sliding skids 6*a, b, c* and *d* merge into each other in the stern area and for example form the larger surface 17 (see FIG. 4).

In a further embodiment of the invention the keel skid changes over into a declining inclination 22 in its rear area, so that a rear edge 23 rising upwards results (see FIGS. 3 and 4).

Mainly, however, the inventive inclination 19 causes compensation for the lifting which is additionally produced by the bow fin when flow is taking effect.

The inclinations 21 convey further a synergistic effect to the desired lifting force; then these inclinations reinforce very substantially the effect of the rudder of the boat. The sliding steps produce a water displacement transversely to the direction of travel outwardly like the effect of a waterfall. This cascade-effect is particularly strong in the area of the inclinations 21. Accordingly there too the counterforce from the side taking effect on the boat is larger than it is further towards the bow. When the rudder is operated, as is well known, the boat firstly begins its curve, i.e. in the direction in which it is to travel. Only subsequently does the centrifugal force take effect and incline the boat in the counter direction out of the curve. In the first inclination phase, when the boat enters the curve, a greater cascade effect is produced on the curve side and connected therewith a higher force acting on the boat from the outside transversely to the direction of travelling, which force presses the boat to the side in the stern area and thus reinforces the effect of the rudder. The boat turns faster and with a smaller turning circle.

In accordance with a special embodiment of the invention (not shown) which is easy to comprehend, a device is provided which supports the inclination 19, said device being arranged around an axis which is horizontal and transverse to the midships plane, preferably being pivotable downwards on the bottom of the boat and is preferably arranged at the beginning of inclination 19, for example as a wedge shaped additional portion which can be adjusted by mechanical or motor means so that the inclination 19 can be pivoted more deeply downwards. Thereby an adjustment of the lifting force to, for example, other stress situations on the boat is made possible.

A further embodiment of the invention provides for an identical design for the sliding steps and optionally also for the keel steps.

The inventive fast motorboat is also particularly suitable for equipment with a pump-jet-drive which is known per se. A pump-jet-drive sucks the water by means of a turbine wheel under the bottom of the boat. In a quarter bend the water is charged with energy in order to be ejected again at an angle of about 15° under the bottom of the boat. The pump-jet-drive is built into a so-called well shaft, the bottom edge of which finishes at the bottom of the boat, the power of the engine is converted into thrust which is simultaneously available for forward drive and for control in any required direction. Boats which are equipped with pump-jet-drive possess high manoeuvreability. The equipment of fast boat with a pump-jet-drive was previously problematical, because in the case of these boats not enough water pressure is generated on the bottom of the boat. By means of the inclination 19, and in particular of the adjustable inclination, the pressure is however increased so that optimal conditions are provided for the operation of a pump-jet-drive. FIG. 5 shows an example of the arrangement of a pump-jet-drive 24 in the case of a fast boat according to the invention.

A special embodiment of keel skids 6 is shown by FIGS. 6 and 7, which is particularly suitable when using two pump-jet-drives arranged in the stern area of the sliding steps. This is a relatively broader keel step **6*b*, in comparison to the other keel steps, in the stern area of which a pump-jet-drive 24 is arranged. The keel step 6*b* has the inclination 21 described above. On the two outer edges of the keel steps, wedge-shaped water guide bars 25 which begin approximately in the middle of the boat, as shown in FIG. 6, and which are oriented perpendicularly downwards extending towards the rear in a wedge shape, as indicated in FIG. 7 when taken in view of the showing in FIG. 6, are arranged, effecting a higher flow speed, so that the water pressure in the area of drive 24 is thereby additionally increased. These bars 25 end shortly before the pump-jet-drives 24. It is particularly advantageous when connected with bar 25, inclination 21** is designed to extend downwards more steeply than before (not shown).

Thus, because the inclination is formed concavely and arcuately, as shown in the drawings, the inclination 19 is composed of several consecutive inclinations, each successive inclination having a greater angle than the previous one. Accordingly, as shown in the drawings, angle $\beta$ of FIG. **2*a* taken from position 19*a* is greater than angle $\beta_1$, of FIG. 2*b* taken from position 19*b*, and angle $\beta_1$ is greater than angle $\beta_2$ of FIG. 2*c* taken from position 19*c***.

It is practical that the inclinations 19, or 21, 22 do not result from an inclination of the ceiling of the channel in the forward area of the boat, but arise out of the longitudinal middle area, for example the bottom plate 4, of the boat. The result is—seen from the side—for example nearly a sinus curve if the forward-lying channel ceiling is formed convex-arcuately, or an inclination bent downwards more steeply, if the forward-lying channel ceiling inclines downwards.

FIGS. 1, **2*a*, *b*, *c*, 3, 5 and 9*c* show schematic side views, in which the inclination 19**, which normally cannot be recognized in the side view, is represented in a distinct line so that the invention can be better explained.

FIGS. **9*a*, *b*, *c* show important features of the invention. Shown is the statical floatation position, this means the position of the boat at stand still on the water. The weight of the boat in combination with the lifting forces, which effect the bottom of the ship up to the water line, is distributed such, that the front approach inclinations (angle $\alpha$) or at least partial areas of the approach inclinations of the keel skid 10 and the slide skids 6 are positioned above the water line 26 (FIG. 9*c*) and then submerge into the water in the area between the leading edge and the longitudinal middle of the bottom plate 4. In the area of the longitudinal middle of the bottom plate 4 all skids are under water. In addition the channel ceiling, or the forward-lying bottom surface facing the water 5 is above the water line 26 from the leading edge of the bottom plate 4 to approximately the longitudinal middle of the bottom plate 4 and forms with the water line 26 a up to the longitudinal middle of the bottom plate 4 narrowing wedge-shaped hold. In connection with the submersion of the channel ceiling or the bottom surface facing the water 5 in the water, the bottom surface facing the water 5 extends as inclination 19 further to the rear up to the end of bottom plate 4. FIG. 9*c* shows moreover in addition perfectly a water line 26*a* lying somewhat deeper, which results from a higher speed. Thereby it is essential that the inclinations 19 still reach under the water line 26, this means that they are wetted from the water. The floatation position of the boat is represented schematically in FIG. 9*b*. These are schematic cross sections each at the point of the boat hull which are opposite to the point in FIG. 9*c*. FIGS. 9*a*, *b* and *c* belong together so far as FIG. 9*b* represents a cross-section each at the point, which according to the drawings is located at the same height in the FIGS. 9*a* and 9*c*. It is recognizable that the inclinations 19 are always at least partially, positioned under water and that at least an outer step of the slide skid 6 is arranged above the water line 26. The upper cross-sectional view shows this position in comparison to the lower cross-sectional view in FIG. 9*b*. The slide skid step 6*d* is above the water line while the inclination 19** lies in water.

This arrangement of the skids to the arrangement of the inclination 19 guarantees a levering out of the boat hull, if the dynamic pressure effects the inclinations 19 while sailing and the boat hull is pitched forwards. The water hits then the surfaces of the skid **6*d* not as yet wetted and generates a counterbalancing lifting so that the boat is lifted further out of the water in an almost horizontal position, this means that the water line is displaced downwards (water line 26*a***).

If the inclination 19 is positioned under water then it counteracts the heeling (rolling) of the boat, since the dynamic pressure of the water has a stronger effect on the diagonal pitched surfaces of the inclinations 19 while sailing the boat.

In accordance with a preferred specific embodiment of the invention the edges of skid 10 and 6 extend parallel to the midships plane.

I claim:

1. In a fast boat including a boat hull having a longitudinal centre line with a front stem, a stern, two side walls and a bottom plate having a bottom surface facing the water, in which on each side of said longitudinal centre line on said bottom surface respectively is a sliding skid provided with outward ascending, stepped sliding steps which are graded with respect to each other, and a keel skid in a midships plane is provided with outward ascending, stepped keel steps which are graded with respect to each other and arranged on both sides thereof, wherein said bottom surface disposed between said sliding skids provides a bottom wall for at least one aeration channel, and said boat hull is equipped with a bow fin, an improvement comprising:

means to provide lifting forces for acting upon said boat hull at substantialy all speeds to maintain the boat in a predetermined statical and/or dynamic floatation position in the water relative to a water line (26) of the boat to obtain optimal driving navigational qualities, wherein the weight of the boat in combination with the lifting forces, which work against an underwater part of the boat hull up to the water line (26), are distributed such that at least partial areas of front approach inclinations of the keel skid (10) and the sliding skids (6) are positioned above the water line (26) and then are submerged into the water below the water line (26) in an area between a leading edge of the bottom plate (4) and longitudinal middle of the bottom plate (4);

a forward-lying portion of the bottom surface (5) in said floatation position being above the water line (26) from the leading edge of the bottom plate (4) to about the longitudinal middle of the bottom plate (4) to form with the water line (26) a wedge-shaped space narrowingly extending to the longitudinal middle of the bottom plate (4);

said means including a first inclination (19) provided in said bottom surface (5) between the sliding skids (6), said first inclination (19) extending rearwardly from the bottom wall of the aeration channel (20) so that the lifting forces generated by the aeration channel (20) act against said first inclination (19) to lift up said boat hull;

said first inclination (19) being positioned between a longitudinal centre of the boat and the stern;

said first inclination (19) declining in a downwardly direction from said longitudinal centre towards the stern relative to the sliding skid (6); and a second inclination (21) being arranged in a stern area of at least one of the sliding steps (6*a*, 6*b*, 6*c*, 6*d*) to coact with said first inclination (19) for lifting up said boat hull.

2. Fast boat as set forth in claim 1, wherein the first inclination (19) arises without an edge in the bottom surface (5).

3. Fast boat as set forth in claim 1, wherein said first inclination (19) is composed of several consecutive inclinations, each successive inclination having a greater angle ($\beta$) than the previous one.

4. Fast boat as set forth in claim 1, wherein the first inclination (19) is formed concavely and arcuately.

5. Fast boat as set forth in claim 1, wherein a cutting angle ($\beta$) of the first inclination (19) corresponds approximately to a cutting angle ($\alpha$) of the sliding steps (6*a, b, c, d*).

6. Fast boat as set forth in claim 1, wherein the longitudinal edges of the skids (10 and 6) or their steps extend parallel to the midships plane.

7. Fast boat as set forth in claim 1, wherein at least two sliding steps (6*a, b, c, d*) merge into each other without an edge in the stern area and form a greater surface (17).

8. Fast boat as set forth in claim 1, wherein said keel skid (10) has a declining inclination (22) with a rear edge (23) which projects upwards in a rear area.

9. Fast boat as set forth in claim 8, wherein the inclinations (19, 21 and 22) when compared to inclinations in a bow portion of the boat—when observed from the side—extend downwards more steeply.

10. Fast boat as set forth in claim 1, wherein at least an outer step (6*d*) of the sliding skids (6) is arranged above the water line (26).

11. Fast boat as set forth in claim 1, wherein it is equipped in a stern area with at least one pump-jet-drive (24).

12. Fast boat as set forth in claim 1, wherein at least one sliding step (6*a, b, c, d*) has on both its outer side portions a wedge shaped water guidance bar (25) which extends perpendicularly downwards, beginning approximately in the longitudinal centre and extending towards the stern.

13. Fast boat as set forth in claim 1, wherein the inclination (21) in a first statical as well in a dynamic floatation position is always arranged under water.

14. Fast boat as set forth in claim 1, wherein the first inclination (19) is always positioned under water at least partially.

* * * * *